US010609461B1

(12) United States Patent
Lo

(10) Patent No.: US 10,609,461 B1
(45) Date of Patent: Mar. 31, 2020

(54) WATERPROOF SPEAKER DEVICE

(71) Applicant: Getac Technology Corporation, Hsinchu County (TW)

(72) Inventor: Chi-Chen Lo, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 16/167,793

(22) Filed: Oct. 23, 2018

(51) Int. Cl.

| | |
|---|---|
| ***H04R 1/02*** | (2006.01) |
| ***H04R 7/18*** | (2006.01) |
| ***H04R 9/06*** | (2006.01) |
| ***H04R 1/44*** | (2006.01) |

(52) U.S. Cl.
CPC ..... *H04R 1/025* (2013.01); *H04R 1/026* (2013.01); *H04R 1/44* (2013.01); *H04R 7/18* (2013.01); *H04R 9/06* (2013.01); *H04R 2499/11* (2013.01)

(58) Field of Classification Search
CPC ..... H04R 1/023; H04R 1/025; H04R 1/026; H04R 1/086; H04R 1/44; H04R 7/18; H04R 9/06; H04R 2499/11; H04R 1/02; H04R 1/10; H04R 1/28; H04R 5/02; G10K 11/00; H05K 5/06
USPC ..... 181/149; 381/189, 334, 349, 386, 398
See application file for complete search history.

(56) References Cited

U.S. PATENT DOCUMENTS

| | | | | |
|---|---|---|---|---|
| 4,321,432 | A * | 3/1982 | Matsutani | H04R 1/04 381/174 |
| 4,949,386 | A * | 8/1990 | Hill | H04R 1/026 181/149 |
| 6,626,262 | B1 * | 9/2003 | Chen | H04R 9/043 181/149 |
| 9,008,342 | B1 * | 4/2015 | Hagman | H04R 1/44 381/334 |
| 9,313,570 | B1 * | 4/2016 | Hagman | H04R 1/44 |
| 2003/0123692 | A1 * | 7/2003 | Ueki | H04R 1/44 381/398 |
| 2004/0081325 | A1 * | 4/2004 | Rautio | H04M 1/03 381/189 |
| 2011/0311093 | A1 * | 12/2011 | He | H04R 9/06 381/410 |
| 2013/0223656 | A1 * | 8/2013 | Iuchi | H04R 1/023 381/189 |

(Continued)

*Primary Examiner* — Gerald Gauthier
(74) *Attorney, Agent, or Firm* — Locke Lord LLP; Tim Tingkang Xia, Esq.

(57) ABSTRACT

A waterproof speaker device includes a plate member, a speaker unit and a waterproof frame. The plate member includes an encircling block wall and a sound hole. The encircling block wall is provided on the plate member, and the sound hole passes through the plate member and is located within the encircling block wall. The encircling block wall is quadrilateral and includes four first positioning portions, and the first positioning portions are respectively located at four corners of the encircling block wall. The speaker unit is near the sound hole, and the encircling block wall surrounds the speaker unit. The waterproof frame is located between the encircling block wall and the speaker unit. The waterproof frame is quadrilateral and includes four second positioning portions, the second positioning portions are respectively located at four corners of the waterproof frame, and the first positioning portions respectively match the second positioning portions.

9 Claims, 4 Drawing Sheets

(56) References Cited

U.S. PATENT DOCUMENTS

| | | | | |
|---|---|---|---|---|
| 2014/0119587 | A1* | 5/2014 | Chou | H04R 1/44 381/334 |
| 2014/0254849 | A1* | 9/2014 | Abe | H04R 1/086 381/334 |
| 2014/0369542 | A1* | 12/2014 | Lee | H04R 1/025 381/334 |
| 2015/0222985 | A1* | 8/2015 | Lin | H04R 1/44 381/334 |
| 2016/0205469 | A1* | 7/2016 | Steijner | H04R 1/44 381/334 |
| 2016/0212526 | A1* | 7/2016 | Salvatti | H04R 1/44 |
| 2016/0219367 | A1* | 7/2016 | Florczak | H04R 1/44 |
| 2017/0013337 | A1* | 1/2017 | Costello | H04R 1/028 |
| 2017/0026734 | A1* | 1/2017 | Walker | H04R 1/1016 |
| 2017/0026742 | A1* | 1/2017 | Karube | H04R 1/44 |
| 2017/0195784 | A1* | 7/2017 | Chou | H04R 1/24 |
| 2018/0063981 | A1* | 3/2018 | Park | G04B 39/025 |
| 2018/0084339 | A1* | 3/2018 | Asuncion | H04R 1/44 |
| 2018/0167738 | A1* | 6/2018 | Liu | H04R 9/06 |
| 2018/0184198 | A1* | 6/2018 | Cross | H04R 1/2834 |
| 2018/0234768 | A1* | 8/2018 | Kong | H04R 5/02 |
| 2019/0098385 | A1* | 3/2019 | Han | H04R 9/02 |
| 2019/0259363 | A1* | 8/2019 | Seo | B32B 7/12 |

* cited by examiner

WATERPROOF SPEAKER DEVICE

BACKGROUND OF THE INVENTION

Field of the Invention

The present invention relates to speaker devices and, more particularly, to a waterproof speaker device.

Description of the Prior Art

A current portable electronic device is usually equipped with a speaker device. For example, a smartphone or a tablet computer is provided with a small speaker so as to play sound during a call or when operated. Since the design of a portable electronic device is aimed at being light, slim and small, circuit boards, electronic components, wires and mechanisms in the portable electronic device are also configured to utilize the internal space with maximum efficiency. In the above situation, a conventional circular speaker disfavors space utilization. Thus, a speaker device of many portable electronic devices is implemented by a quadrilateral speaker.

In the recent years, waterproof performance of portable electronic devices is increasingly valued. Now that a portable electronic device is for easy portability of the user and can be used by the user at all times, compared to an electronic device placed at a fixed location, e.g., a television or a desktop computer, an application environment of a portable electronic device is more complex. For example, a portable electronic device used outdoors can be easily wetted by rain. In response to complex application environments, many portable electronic devices are designed with a certain level of waterproofness. However, on a casing of a portable electronic device, a hole for communicating with the exterior needs to be provided at a position near a speaker device in order to effectively transmit sound waves. In the above situation, to prevent liquid from entering through the hole and further entering the inside of the casing through a gap between the speaker device and the casing, the speaker device requires a waterproof structure. In a conventional approach, a waterproof rubber frame is additionally provided around a speaker device to fill the gap between the speaker device and a block wall of the casing, and thereby achieving a waterproof function.

SUMMARY OF THE INVENTION

As previously described, current light, slim and small-size portable electronic devices mostly adopt a quadrilateral speaker as a speaker device, and a waterproof rubber frame corresponding to such quadrilateral speaker is also quadrilateral. The quadrilateral waterproof rubber frame is clamped between the quadrilateral speaker and a quadrilateral block wall of a casing so as to fill the gap therebetween. However, in practice, gaps caused by assembly tolerances are still likely incurred between the four corners of a quadrilateral waterproof rubber frame and the four corners of a quadrilateral speaker or a quadrilateral block wall as these corners are turning points. In addition, when a portable electronic device encounters a collision, the four corners of a waterproof rubber frame can also produce gaps due to shifts from the force received. Once gaps are produced between the four corners of a waterproof rubber frame and the four corners of a quadrilateral speaker or a quadrilateral block wall, the waterproof function fails.

In view of the above, it is an object of the present invention to provide a waterproof speaker device. With a positioning structure of a waterproof frame and an encircling block wall matching each other, the possibility of gaps produced between the waterproof frame and the encircling block wall due to assembly tolerances or collisions is eliminated.

According to an embodiment of the present invention, a waterproof speaker device includes a plate member, a speaker unit and a waterproof frame. The plate member includes an encircling block wall and a sound hole. The encircling block wall is provided on the plate member, and the sound hole passes through the plate member and is located within the encircling block wall. The encircling block wall is quadrilateral and includes four first positioning portions which are respectively located at four corners of the encircling block wall. The speaker unit is near the sound hole, and the encircling block wall surrounds the speaker unit. The waterproof frame is located between the encircling block wall and the speaker unit. The waterproof frame is quadrilateral and includes four second positioning portions which are respectively located at four corners of the waterproof frame. The four first positioning portions respectively match the four second positioning portions.

In conclusion, in a waterproof speaker device disclosed according to an embodiment of the present invention, a positioning effect is achieved by matching the first positioning portions of the encircling block wall with the second positioning portions of the waterproof frame, so as to eliminate the possibility of gaps produced between the waterproof frame and the encircling block wall due to assembly tolerances or collisions. Thus, a tight-fit and gap-free state can be maintained between the waterproof frame and the encircling block wall, and thereby achieving outstanding and durable waterproof performance.

Details of features and advantages of the present invention are described in the detailed description below. The disclosure is sufficient for a person skilled in the art to understand and accordingly implement the technical contents of the present invention. Furthermore, on the basis of the contents, claims and drawings disclosed by the application, a person skilled in the art can easily appreciate objects and advantages related to the present invention.

DETAILED DESCRIPTION OF THE EMBODIMENTS

Figure 1:
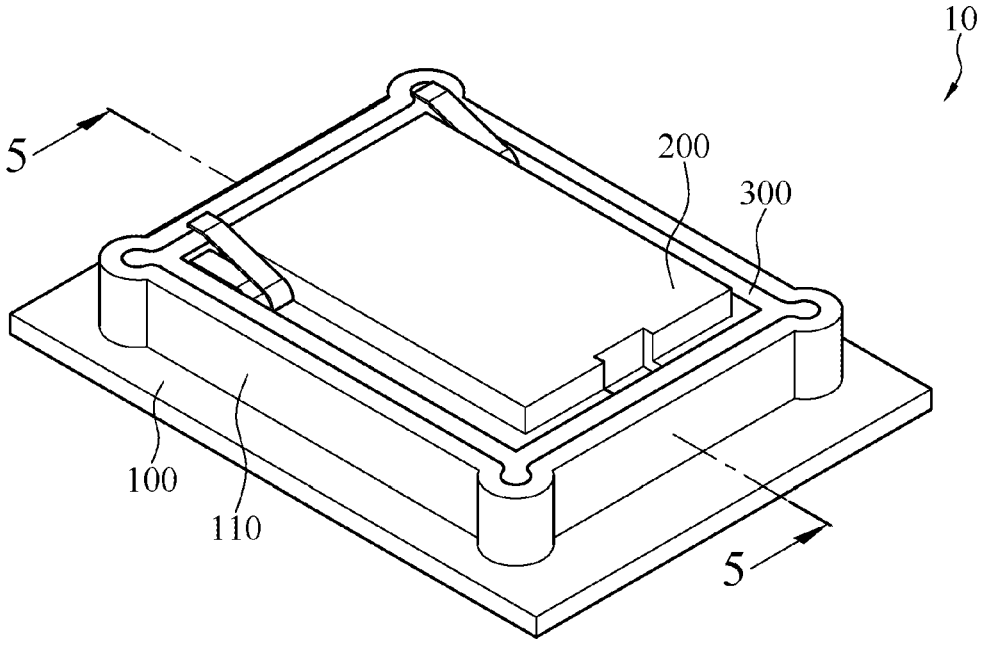
FIG. 1 is a perspective schematic diagram of a waterproof speaker device according to an embodiment of the present invention.
Figure 2:
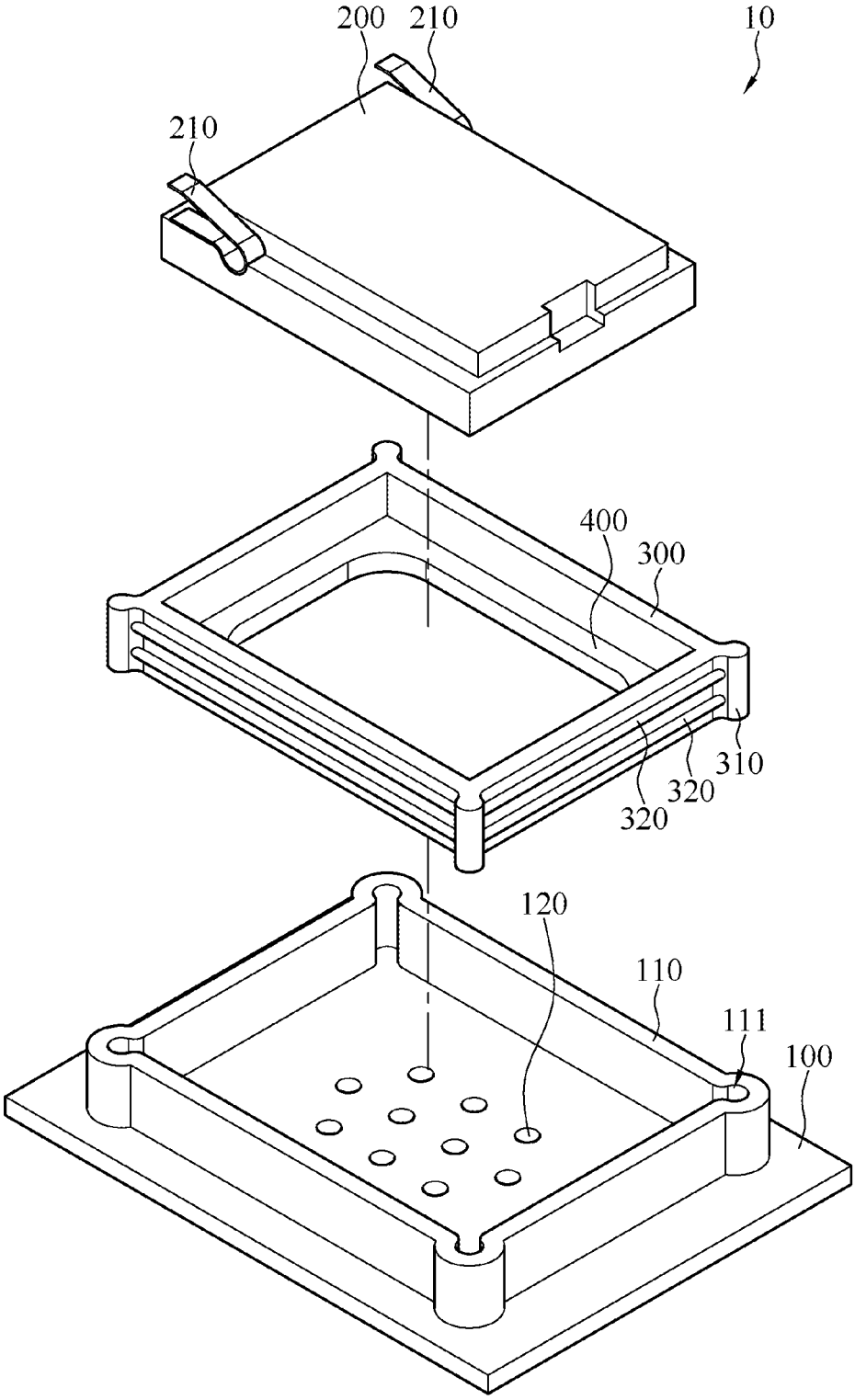
FIG. 2 is an exploded schematic diagram of the waterproof speaker device in FIG. 1.

FIG. 1 shows a perspective schematic diagram of a waterproof speaker device 10 according to an embodiment of the present invention. FIG. 2 shows an exploded schematic diagram of the waterproof speaker device in FIG. 1.

Referring to FIG. 1 and FIG. 2, in this embodiment, the waterproof speaker device 10 is applicable to a portable electronic device, for example but not limited to, the waterproof speaker device 10 may be installed on a smartphone having a waterproof function. The waterproof speaker device 10 includes a plate member 100, a speaker unit 200 and a waterproof frame 300. In this embodiment, the plate member 100 may be a part of a casing (not shown) of the portable electronic device. In a different embodiment, the plate member 100 may also be an independent component, and is assembled on the casing of the portable electronic device and together with the casing forms a consistent appearance.

As shown in FIG. 1 and FIG. 2, in this embodiment, the plate member 100 includes an encircling block wall 100 and a sound hole 120. The encircling block wall 110 is provided on one side of the plate member 100, and the sound hole 120 passes through the plate member 100 and is located within the encircling block wall 110. The speaker unit 200 is near the sound hole 120, and the encircling block wall 110 surrounds the speaker unit 200. The speaker unit 200 is for generating sound waves which are transmitted to the exterior through the sound hole 120. The waterproof frame 300 is located between the encircling block wall 110 and the speaker unit 200, and the waterproof frame 300 is tightly fit with the encircling block wall 110 and the speaker unit 200, such that the waterproof frame 300 fully fills the gap between the encircling block wall 110 and the speaker unit 200, and thereby achieving a waterproof function. Even if external liquid passes through the sound hole 120 and enters between the plate member 100 and the speaker unit 200, the liquid cannot further pass through the plate member 100, and the waterproof frame 300 between the encircling block wall 110 and the speaker unit 200. That is to say, the waterproof speaker device 10 can serve as a part of a portable electronic device, and the liquid cannot enter the inside of the portable electronic device through the waterproof speaker device 10.

As shown in FIG. 1 and FIG. 2, in this embodiment, the speaker unit 200 is a quadrilateral speaker; correspondingly, the encircling block wall 110 is quadrilateral and the waterproof frame 300 is also quadrilateral. The quadrilateral speaker occupies smaller space and is beneficial for integrating with other internal components. The encircling block wall 110 includes four first positioning portions 111 which are respectively located at four corners of the encircling block wall 110. The waterproof frame 300 includes four second positioning portions 310 which are respectively located at four corners of the waterproof frame 300. Furthermore, the four first positioning portions 111 respectively match the four second positioning portions 310.

Figure 3:
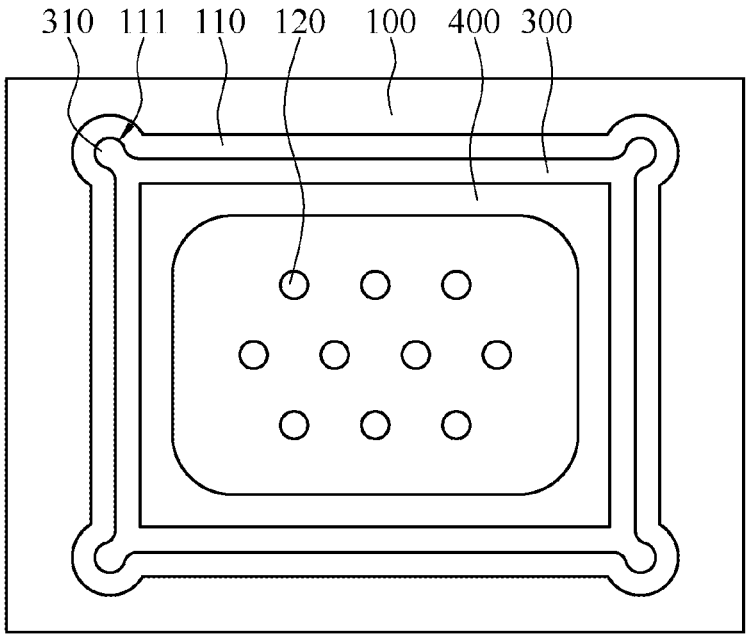
FIG. 3 is a top schematic diagram of a plate member and a waterproof frame of the waterproof speaker device in FIG. 1.

Refer to FIG. 3 showing a top schematic diagram of the plate member 100 and the waterproof frame 300 of the waterproof speaker device 10 in FIG. 1. As shown in FIG. 1 to FIG. 3, in this embodiment, the first positioning portions 111 are cylindrical slots, and the four first positioning portions 111 are respectively four cylindrical slots located at the four corners of the encircling block wall 110. The first positioning portions 111 in the form of cylindrical slots are recessed towards a direction away from the waterproof frame 300, and are respectively provided in a recessed manner at the four corners of the encircling block wall 110. The second positioning portions 310 are cylindrical protrusions, and the four second positioning portions 310 are four cylindrical protrusions respectively located at the four corners of the waterproof frame 300. The second positioning portions 310 in the form of cylindrical protrusions extend towards a direction away from the speaker unit 200, and the four second positioning portions 310 are respectively provided in a projecting manner at the four corners of the waterproof frame 300. The second positioning portion 310 in the form of cylindrical protrusions and the first positioning portions 111 in the form of cylindrical slots are structurally matching.

As shown in FIG. 2, for assembly, an assembly staff can first align the four second positioning portions 310 of the waterproof frame 300 with the four first positioning portions 111 of the encircling block wall 110, and then place the waterproof frame 300 within the encircling block wall 110. During the process of such placement, the second positioning portions 310 in the form of cylindrical protrusions are inserted into the first positioning portions 111 in the form of cylindrical slots and gradually enter deeper therein, until the waterproof frame 300 is completely placed in the encircling block wall 110 and comes into contact with the plate member 100. At this point in time, the second positioning portions 310 in the form of cylindrical protrusions are completely inserted into the first positioning portions 111 in the form of cylindrical slots, such that the four second positioning portions 310 in the form of cylindrical protrusions are respectively accommodated in the four first positioning portions 111 in the form of cylindrical slots. Furthermore, as shown in FIG. 1, in this embodiment, one side surface of the waterproof frame 300 away from the plate member 100 is, for example but not limited to, aligned with the encircling block wall 110. After the waterproof frame 300 is assembled with the encircling block wall 100, the assembly staff can then place the speaker unit 200 within the waterproof frame 300. Since the waterproof frame 300, the encircling block wall 110 and the speaker unit 200 are arranged as tightly fit with one another, when the speaker unit 200 is placed within the waterproof frame 300, the speaker unit 200 and the encircling block wall 110 together press against the waterproof frame 300, such that the waterproof frame 300 is compressed and becomes elastically deformed a little and the waterproof frame 300 presses against the encircling block wall 110 and the speaker unit 200 as a result of the elastic restoring force, and thus the encircling block wall 110, the waterproof frame 300 and the speaker unit 200 are in a tight-fit and gap-free state.

Since the first positioning portions 111 and the second positioning portions 310 mutually match and provide a positioning effect, when the waterproof frame 300 is pressed by the speaker unit 200 and the encircling block wall 110 and becomes elastically deformed, the second positioning portions 310 located at the four corners of the waterproof frame 300 are positioned and contained mutually with the first positioning portions 111 located at the four corners of the encircling block wall 110, preventing any relative shifts of the four corners of the waterproof frame 300 and the four corners of the encircling block wall 110. Thus, a tight-fit state is kept between the waterproof frame 300, the speaker unit 200 and the encircling block wall 110, avoiding shifts caused by assembly errors or tolerances and preventing gaps from being produced, and thereby ensuring the waterproof performance of the assembled waterproof speaker device 10. In addition, on the basis of the mutual positioning and containing structures of the first positioning portions 111 and the second positioning portions 310, even if the waterproof speaker device 10 encounters severe collisions, relative positions of the four corners of the waterproof frame 300 and the four corners of the encircling block wall 110 are kept unchanged. Since the relative positions of four corners of the waterproof frame 300 and the four corners of the encircling block wall 110 are kept unchanged, the relative positions of the four edges of the waterproof frame 300 and the four edges of the encircling block wall 110 are also kept unchanged, and thereby maintaining the tight-fit and gap-free state between the waterproof frame 300, the encircling block wall 110 and the speaker unit 200.

Figure 4:
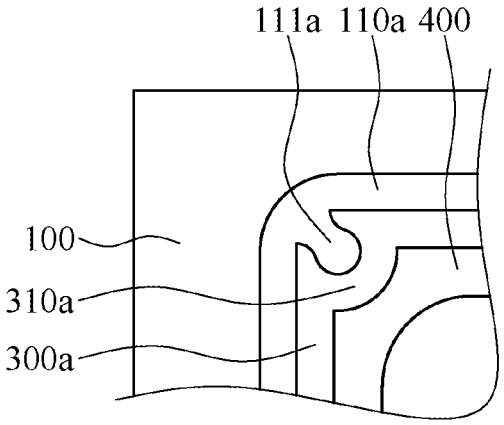
FIG. 4 is a partial top view of a plate member and a waterproof frame of a waterproof speaker device according to another embodiment of the present invention.

Refer to FIG. 4 showing a partial top view of an encircling block wall 110*a* of the plate member 100 and a waterproof frame 300*a* of the waterproof speaker device 10 according to another embodiment of the present invention. One difference between the encircling block wall 110*a* and the waterproof frame 300*a* shown in FIG. 4 and the encircling block wall 110 and the waterproof frame 300 shown in FIG. 1 to FIG. 3 is that, first positioning portions 111*a* of the encircling block wall 110*a* are cylindrical protrusions. That is, the four first positioning portions 111*a* are four cylindrical protrusions respectively located at the four corners of the encircling block wall 110*a*, and the four first positioning portions 111*a* in the form of cylindrical protrusions extend towards a direction of the waterproof frame 300*a*. Second positioning portions 310*a* of the waterproof frame 300*a* are cylindrical slots. That is, the four second positioning portions 310*a* are four cylindrical slots respectively located at the four corners of the waterproof frame 300*a*, and the four second positioning portions 310*a* in the form of cylindrical slots are recessed towards a direction away from the encircling block wall 110*a*. The second positioning portions 310*a* in the form of cylindrical slots and the first positioning portions 111*a* in the form of cylindrical protrusions are structurally matching. The four first positioning portions 111*a* in the form of cylindrical protrusions are respectively accommodated in the four second positioning portions 310*a* in the form of cylindrical slots. However, in a different embodiment, the first positioning portions 111 and 111*a*, and the second positioning portions 310 and 310*a* may also be other matching geometric shapes, and are not limited to the foregoing cylindrical protrusions and cylindrical slots.

Figure 5:
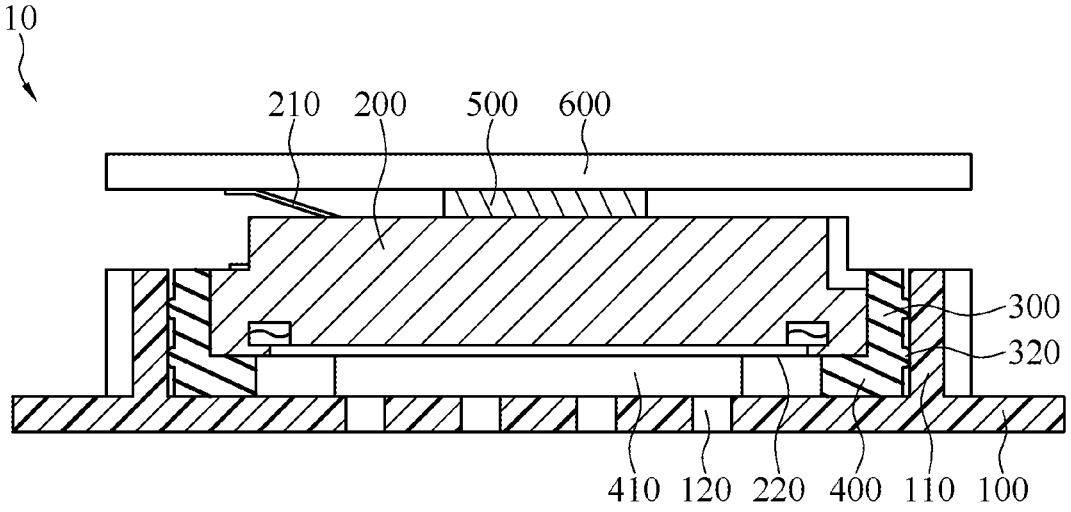
FIG. 5 is a cross-sectional schematic diagram of the waterproof speaker device in FIG. 1 along a section line 5-5.

Refer to FIG. 5 showing a cross-sectional schematic diagram of the waterproof speaker device 10 in FIG. 1 along a section line 5-5. As shown in FIG. 2 and FIG. 5, in this embodiment, the waterproof frame 300 further includes at least one rib 320 that is provided in a projecting manner on one side surface of the waterproof frame 300 adjacent to the encircling block wall 110 and is located at four edges of the waterproof frame 300. The rib 320 is for interfering with the encircling block wall 110 to enhance waterproofness. As shown in FIG. 5, in this embodiment, the waterproof frame 300 is clamped between the encircling block wall 110 and the speaker unit 200, and the rib 320 is further compressed by the interference with the encircling block wall 110 and generates elastic deformation. Thus, the rib 320 is more tightly abutted against the encircling block wall 110, further ensuring the gap-free state between the waterproof frame 300 and the encircling block wall 110. Furthermore, the rib 320 and the waterproof frame 300 are integrally formed. In this embodiment, there are two ribs 320 which are arranged at an interval, for example but not limited to. In a different embodiment, the quantity of the rib 320 may be three or more. In this embodiment, the rib 320 does not extend onto the second positioning portions 310 in the form of cylindrical protrusions, so as to allow the second positioning portions 310 to be smoothly inserted into the first positioning portions 111 during an assembly process. In a different embodiment, the rib 320 may also extend onto the second positioning portions 310 in the form of cylindrical protrusions to enhance waterproofness.

As shown in FIG. 5, in this embodiment, the waterproof speaker device 10 further includes a pressing member 500. The pressing member 500 abuts against one side surface of the speaker unit 200 away from the plate member 100, and can press against the speaker unit 200 to force the speaker unit 200 to abut against the plate member 100. Thus, the speaker unit 200 is prevented from being pushed away from the waterproof frame 300 when the waterproof frame 300 receives an external pressure or collision.

As shown in FIG. 5, in this embodiment, the waterproof speaker device 10 further includes a circuit board 600. The circuit board 600 is electrically connected to the speaker unit 200 to transmit power and signals to the speaker unit 200. In general, the circuit board 600 may be fixed at a predetermined position in the portable electronic device through a corresponding engagement structure, such as a screw or a tenon. The pressing member 500 is provided on the circuit board 600, and is clamped between the circuit board 600 and the speaker unit 200. That is to say, the pressing member 500 can press against the speaker unit 200 through the circuit board 600, and force the speaker unit 200 to abut against the plate member 100. In this embodiment, the pressing member 500 is, for example, a rubber block, and can be fixed by means of adhesion or engagement on the circuit board 600. In other embodiments, the circuit board 600 itself may also act as the pressing member 500. That is to say, the circuit board 600 can directly contact and press on the speaker unit 200.

As shown in FIG. 2 and FIG. 5, in this embodiment, the speaker unit 200 further includes an elastic piece 210 that is located on one side surface of the speaker unit 200 away from the plate member 100. The elastic piece 210 is made of an electrically conductive material, and has one end connected to the speaker unit 200 and the other end abutting against a metal contact (not shown) on the circuit board 600. Thus, the elastic piece 210 can be electrically connected to the circuit board 600 and the speaker unit 200. As shown in FIG. 5, in this embodiment, the speaker unit 200 further includes a diaphragm 220 that is near the sound hole 120. The current and signals of the circuit board 600 can be transmitted to the speaker unit 200 through the elastic piece 210 to drive the diaphragm 220 of the speaker unit 200 to vibrate in response to the signals and to accordingly generate sound waves.

As shown in FIG. 2, FIG. 3 and FIG. 5, in this embodiment, the waterproof speaker device 10 further includes a front frame 400. The front frame 400 is connected to an inner lower periphery of the waterproof frame 300, and the sound hole 120 is located within the front frame 400. The front frame 400 is tightly clamped between the speaker unit 200 and the plate member 100, and thus also enhances waterproofness. Furthermore, as shown in FIG. 5, the front frame 400, the plate member 100 and the speaker unit 200 jointly form a sound cavity 410. The sound cavity 410 provides the diaphragm 220 of the speaker unit 200 with sufficient space for vibration and resonance, preventing the vibration of the diaphragm 220 from interfering the plate member 100 and thus from generating negative effects on the sound quality.

In this embodiment, the waterproof frame 300 and the front frame 400 are integrally formed. In a different embodiment, the waterproof frame 300 and the front frame 400 may be independent parts. For assembly, the front frame 400 is first attached on the plate member 100 by means of adhesion or engagement, and the waterproof frame 300 is then assembled within the encircling block wall 110 according to the assembly process in the foregoing embodiments. In this embodiment, the waterproof frame 300 and the front frame 400 are made of, for example but not limited to, rubber.

In conclusion, in the waterproof speaker device disclosed according to the embodiments of the present invention, a positioning effect is achieved by matching the first positioning portions of the encircling block wall with the second positioning portions of the waterproof frame. Furthermore, on the basis of the positioning and containing structures of the first positioning portions and the second positioning portions, the possibility of gaps produced due to assembly tolerances or collisions between the waterproof frame and the encircling block wall is eliminated. Thus, a tight-fit and gap-free state is maintained between the waterproof frame and the encircling block wall, and thereby achieving outstanding and durable waterproof performance.

While the technical contents of the invention have been disclosed by way of the above preferred embodiments, it is to be understood that the invention is not limited thereto. Modifications and variations made by a person skilled in the art without departing from the spirit of the present invention are to be encompassed in the scope of the present invention. Therefore, the scope of patent protection of the present invention shall be defined by the appended claims.

What is claimed is:

1. A waterproof speaker device, comprising:

a plate member, comprising an encircling block wall and a sound hole, the encircling block wall provided on the plate member, the sound hole passing through the plate member and located within the encircling block wall; wherein the encircling block wall is quadrilateral and comprises four first positioning portions, and the four first positioning portions are respectively located at four corners of the encircling block wall;

a speaker unit, near the sound hole, the encircling block wall surrounding the sound unit;

a waterproof frame, located between the encircling block wall and the speaker unit; wherein the waterproof frame is quadrilateral and comprises four second positioning portions, the four second positioning portions are respectively located at four corners of the waterproof frame, and the four first positioning portions respectively match the four second positioning portions; and a front frame; wherein the front frame is connected to the waterproof frame and is clamped between the speaker unit and the plate member, the sound hole is located within the front frame, and the front frame, the plate member and the speaker unit jointly form a sound cavity.

2. The waterproof speaker device according to claim 1, wherein the first positioning portions are cylindrical slots, and the four cylindrical slots are respectively provided in a recessed manner at the four corners of the encircling block wall; the second positioning portions are cylindrical protrusions, and the four cylindrical protrusions are respectively provided in a projecting manner at the four corners of the waterproof frame; the four cylindrical protrusions are respectively accommodated in the four cylindrical slots.

3. The waterproof speaker device according to claim 1, wherein the first positioning portions are cylindrical protrusions, and the four cylindrical protrusions are respectively provided in a projecting manner at the four corners of the encircling block wall; the second positioning portions are cylindrical slots, and the four cylindrical slots are respectively provided in a recessed manner at the four corners of the waterproof frame; the four cylindrical protrusions are respectively accommodated in the four cylindrical slots.

4. The waterproof speaker device according to claim 1, wherein the waterproof frame further comprises at least one rib, the at least one rib is provided in a projecting manner on one side surface of the waterproof frame adjacent to the encircling block wall and is located at four edges of the waterproof frame, and the at least one rib abuts against the encircling block wall.

5. The waterproof speaker device according to claim 4, wherein the rib is in a quantity of two, and the two ribs are arranged at an interval.

6. The waterproof speaker device according to claim 1, wherein the waterproof frame and the front frame are integrally formed.

7. The waterproof speaker device according to claim 6, wherein the waterproof frame and the front frame are made of rubber.

8. The waterproof speaker device according to claim 1, further comprising a pressing member, and the pressing member abuts against one side surface of the speaker unit away from the plate member.

9. The waterproof speaker device according to claim 8, further comprising a circuit board; wherein the circuit board is electrically connected to the speaker unit, and the pressing member is clamped between the circuit board and the speaker unit.

* * * * *